US009421605B2

(12) United States Patent
Furukawa et al.

(10) Patent No.: US 9,421,605 B2
(45) Date of Patent: Aug. 23, 2016

(54) MOLD RELEASE AGENT AND CASTING METHOD

(75) Inventors: Yuichi Furukawa, Toyota (JP); Toshio Uchida, Kasugai (JP); Setsuyu Hayakawa, Nagoya (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 1765 days.

(21) Appl. No.: 11/883,449

(22) PCT Filed: Oct. 23, 2006

(86) PCT No.: PCT/JP2006/321586
§ 371 (c)(1),
(2), (4) Date: Dec. 11, 2007

(87) PCT Pub. No.: WO2007/049776
PCT Pub. Date: May 3, 2007

(65) Prior Publication Data

US 2011/0042029 A1 Feb. 24, 2011

(30) Foreign Application Priority Data

Oct. 27, 2005 (JP) ..... 2005-313468

(51) Int. Cl.
*B22D 23/00* (2006.01)
*B22C 3/00* (2006.01)
(Continued)

(52) U.S. Cl.
CPC .... *B22C 1/14* (2013.01); *B22C 3/00* (2013.01)

(58) Field of Classification Search
CPC ..... B22C 3/00; B22C 1/14
USPC ..... 106/38.22, 38.24, 38.25
See application file for complete search history.

(56) References Cited

U.S. PATENT DOCUMENTS 4,201,847 A * 5/1980 Kleimann et al. ..... 521/172
4,764,537 A * 8/1988 Horn et al. ..... 521/51
(Continued)

FOREIGN PATENT DOCUMENTS

CN 1173405 A 2/1998
EP 0 628 366 A1 12/1994
(Continued)

OTHER PUBLICATIONS

Chinese Office Action dated Jan. 23, 2009.

*Primary Examiner* — Shuangyi Abu Ali
(74) *Attorney, Agent, or Firm* — Finnegan, Henderson, Farabow, Garrett & Dunner, LLP

(57) ABSTRACT

An object is to propose a mold release agent improving the state of a mold surface by repeating casting cycle so as to extend the life of the metal mold actively, and a casting method using the mold release agent. A water-soluble mold release agent applied on a mold surface of a metal mold contains organic acid or organic acid salt which is reducing and ligand, wherein concentration of a total thereof is not less than 0.01 wt % in using concentration and is not more than a fixed concentration which is stability limit of emulsion of the mold release agent in undiluted concentration. Construction weight ratio of the organic acid or organic acid salt which is reducing and the ligand is in the range from 99/1 to 30/70. The mold release agent is applied on a mold surface of a die casting metal mold, molten metal is injected into the metal mold, and the organic acid or organic acid salt which is reducing in the mold release agent is reacted with a component of the mold surface so as to deoxidize $Fe_2O_3$ on the mold surface to $Fe_3O_4$.

3 Claims, 3 Drawing Sheets

(51) Int. Cl.

| | |
|---|---|
| ***B22C 9/00*** | (2006.01) |
| ***B28B 7/36*** | (2006.01) |
| ***B22C 1/14*** | (2006.01) |

(56) References Cited

U.S. PATENT DOCUMENTS

| | | | | |
|---|---|---|---|---|
| 5,308,393 | A | 5/1994 | Hättich et al. | |
| 5,378,270 | A | 1/1995 | Takashima | |
| 6,579,834 | B2 * | 6/2003 | Maeda et al. | 508/155 |

FOREIGN PATENT DOCUMENTS

| | | |
|---|---|---|
| GB | 1 405 114 | 9/1975 |
| JP | 61-86046 | 5/1986 |
| JP | 3-180243 | 8/1991 |
| JP | 2002-178122 | 6/2002 |
| JP | 2003-275845 | 9/2003 |
| JP | 2004-154833 | 6/2004 |

* cited by examiner before simulative casting after 1 cycle after 100 cycles

MOLD RELEASE AGENT AND CASTING METHOD

CROSS-REFERENCE TO RELATED APPLICATIONS

This application is a national phase application of International Application No. PCT/JP2006/321586, filed Oct. 23, 2006, and claims the priority of Japanese Application No. 2005-313468, filed Oct. 27, 2005, the content of all of which is incorporated herein by reference.

TECHNICAL FIELD

The present invention relates to a mold release agent applied on a mold surface of a metal mold previously at the time of casting and a casting method using the mold release agent.

BACKGROUND ART

A water-soluble mold release agent is easy to treat and is widely adopted as a mold release agent for a die casting metal mold. Commonly, mineral oil, animal oil, vegetable oil, silicon oil, wax, fatty acid or the like is emulsified by a surface active agent and is distributed as the water-soluble mold release agent. The water-soluble mold release agent is used in the state of emulsion diluted with water of suitable amount.

The water-soluble mold release agent is applied on the mold surface of the hot die casting metal mold by spraying. In this case, most water included in the water-soluble mold release agent is vaporized, whereby the water-soluble mold release agent is promoted to adhere to the mold surface, and the metal mold is cooled.

When the water-soluble mold release agent is applied on the mold surface, a reactant, whose main component is iron oxyhydroxide FeOOH, and is oxidized by drying so as to become ferric oxide $Fe_2O_3$. Accordingly, the reaction product of $Fe_2O_3$ is formed on the mold surface after applying the mold release agent thereon.

Well, at the time of casting, oxide film may be generated on a surface of molten metal injected into the metal mold so as to spoil fluidity of molten metal, thereby causing casting defect such as misrun. For solving this problem, an art is proposed so that a mold release agent, which contains a metal hydride, such as calcium hydroxide, sodium hydroxide or lithium hydroxide, as a deoxidizing agent, is applied on the inside of the metal mold, and the casting is performed while the oxide film of the molten metal is deoxidized by the deoxidizing agent resolved by the heat of the molten metal (the Japanese Patent Laid Open Gazette 2004-154833).

At the time of spraying the water-soluble mold release agent to the metal mold, water is vaporized suddenly and dryness occurs. Accordingly, impurities and deteriorated materials adhere to the mold surface, thereby causing the filth of the metal mold. For solving this problem, an art is proposed so that a specific metal chelating agent is mixed with the mold release agent, whereby the filth of the metal mold is prevented while maintaining the function as a mold release agent (the Japanese Patent Laid Open Gazette 2003-275845).

SUMMARY OF THE INVENTION

Problems to be Solved by the Invention

By applying the water-soluble mold release agent on the metal mold, the mold surface is cooled once. However, the mold surface is heated again by injecting the molten metal into the metal mold. Since the cooling and heating are repeated as the above, the mold surface repeats expansion and shrink, thereby generating thermal stress. Accordingly, heat check caused by the thermal fatigue or the like tends to be generated on the mold surface. However, the reaction product of $Fe_2O_3$ formed on the mold surface is hard and the tenacity thereof is low, therefore it is feared that peeling or the like occurs so as to deteriorate the metal mold by the repetition of the casting. If the molten metal enter the deteriorated part, the deterioration is promoted.

Namely, the use of the water-soluble mold release agent may induce the embrittlement of the metal mold, thereby shortening the life of the metal mold.

By the repetition of the casting cycle, the reaction product of $Fe_2O_3$ formed on the mold surface pits the mold surface. Furthermore, the reaction product of $Fe_2O_3$ is coarse. Accordingly, minute unevenness is formed on the mold surface. The molten metal enters the unevenness and then solidifies, whereby large releasing force is required for releasing a cast product from the metal mold. In addition thereto, at the mold polishing work removing metal adhering to the mold surface regularly, the metal adheres to the mold surface firmly so that the metal must be chipped away. Accordingly, the work takes a lot of time. Furthermore, the mold surface is chipped so that the shape of the mold surface is changed, thereby shortening the life of the metal mold.

For solving the above-mentioned problems so as to prevent the deterioration of the metal mold, the surface treatment of the metal mold, the change of the mold release agent, the reform of applying method of the mold release agent and the like have been performed.

However, the surface treatment of the metal mold increases the cost. Furthermore, the treatment is performed before the casting, whereby the treated metal mold cannot often bear the casting cycle performed repeatedly.

As described in the above prior art, there are known the mold release agent including metal hydride as a deoxidizing agent so as to improve flowability of the molten metal, and the mold release agent including chelating agent so as to catch heavy metal in the mold release agent and to prevent the pollution of the metal mold. In addition thereto, there is well known a mold release agent including organic acid, such as fatty acid, carbocyclic or heterocyclic carboxylic acid or polycarboxylic acid, so as to improve the castability, such as adhesive property to the metal mold, flowability of the molten metal, and inhibition of surface imperfection of the product.

However, with regard to each of the conventional arts, the effect preventing the deterioration of the metal mold is insufficient. Also, these conventional arts don't improve the state of the mold surface by the repeated casting cycle so as to extend the life of the metal mold.

Then, the present invention proposes a mold release agent improving the state of the mold surface by repeating casting cycle so as to extend the life of the metal mold actively, and a casting method using the mold release agent.

Following this, the reduction of releasing force for the product, the simplification of the mold polishing work and the inhibition of surface imperfection of the product are realized.

Means for Solving the Problems

The above-mentioned problems are solved by the following means according to the present invention.

As specified in claim 1, a water-soluble mold release agent applied on a mold surface of a metal mold is characterized in that the mold release agent contains organic acid or organic acid salt which is reducing, wherein concentration thereof is not less than 0.01 wt % in using concentration and is not more than a fixed concentration which is stability limit of emulsion of the mold release agent in undiluted concentration.

As specified in claim 2, a water-soluble mold release agent applied on a mold surface of a metal mold, characterized in that the mold release agent contains organic acid or organic acid salt which is reducing and ligand, wherein concentration of a total thereof is not less than 0.01 wt % in using concentration and is not more than a fixed concentration which is stability limit of emulsion of the mold release agent in undiluted concentration.

As specified in claim 3, with regard to a mold release agent as set forth in claim 2, construction weight ratio of the organic acid or organic acid salt which is reducing and the ligand is in the range from 99/1 to 30/70.

As specified in claim 4, with regard to mold release agent as set forth in one of claims 1 to 3, the organic acid is citric acid, malonic acid, tartaric acid, formic acid, oxalic acid, gallic acid, ascorbic acid or the combination of two or more thereof.

As specified in claim 5, a casting method characterized in that casting is performed while performing the processes that a mold release agent as set forth in one of claims 1 to 4 is applied on a mold surface of a metal mold, molten metal is injected into the metal mold, and the organic acid or organic acid salt which is reducing in the mold release agent is reacted with a component of the mold surface so as to deoxidize $Fe_2O_3$ on the mold surface to $Fe_3O_4$.

Effect of the Invention

The present invention constructed as the above brings the following effects.

According to claims 1 to 5, by applying the mold release agent and then performing the casting, $Fe_2O_3$ on the mold surface receives heat and deoxidized to $Fe_3O_4$ (black rust, magnetite) at the casting.

Namely, $Fe_2O_3$ on the mold surface and with low tenacity is deoxidized to $Fe_3O_4$ with high tenacity, whereby a fine surface film of $Fe_3O_4$ is formed on the mold surface. The mold surface covered by the surface film of $Fe_3O_4$ can transform following the thermal expansion and contraction, whereby the generation of heat crack is prevented so as to prevent the life of the metal mold from being shortened.

By the casting cycle performed repetitively, the surface film of $Fe_3O_4$ formed on the mold surface becomes finer, whereby the state of the mold surface is improved further so as to extend the life of the metal mold actively.

Furthermore, the surface film of $Fe_3O_4$ formed on the mold surface is finer than the reaction product of $Fe_2O_3$ so that the releasing force is reduced and entrainment of air bubbles into the molten metal is reduced, whereby the surface imperfection of the product is inhibited. Moreover, the surface film of $Fe_3O_4$ is superior in the resistance against the meltdown by the molten metal. Accordingly, it is not necessary to chip the mold surface at the mold polishing work, whereby the work becomes easy; and the shape of the mold surface is maintained so as to prevent the life of the metal mold from being shortened.

Especially, according to claims 2 to 5, by adding the ligand to the mold release agent, the synergistic effect is obtained that the amount of $Fe_3O_4$ generated by the deoxidization of $Fe_2O_3$ by the organic acid or organic acid salt which is reducing is increased.

THE BEST MODE FOR CARRYING OUT THE INVENTION

Next, a best embodiment of the present invention will be explained.

Figure 1:
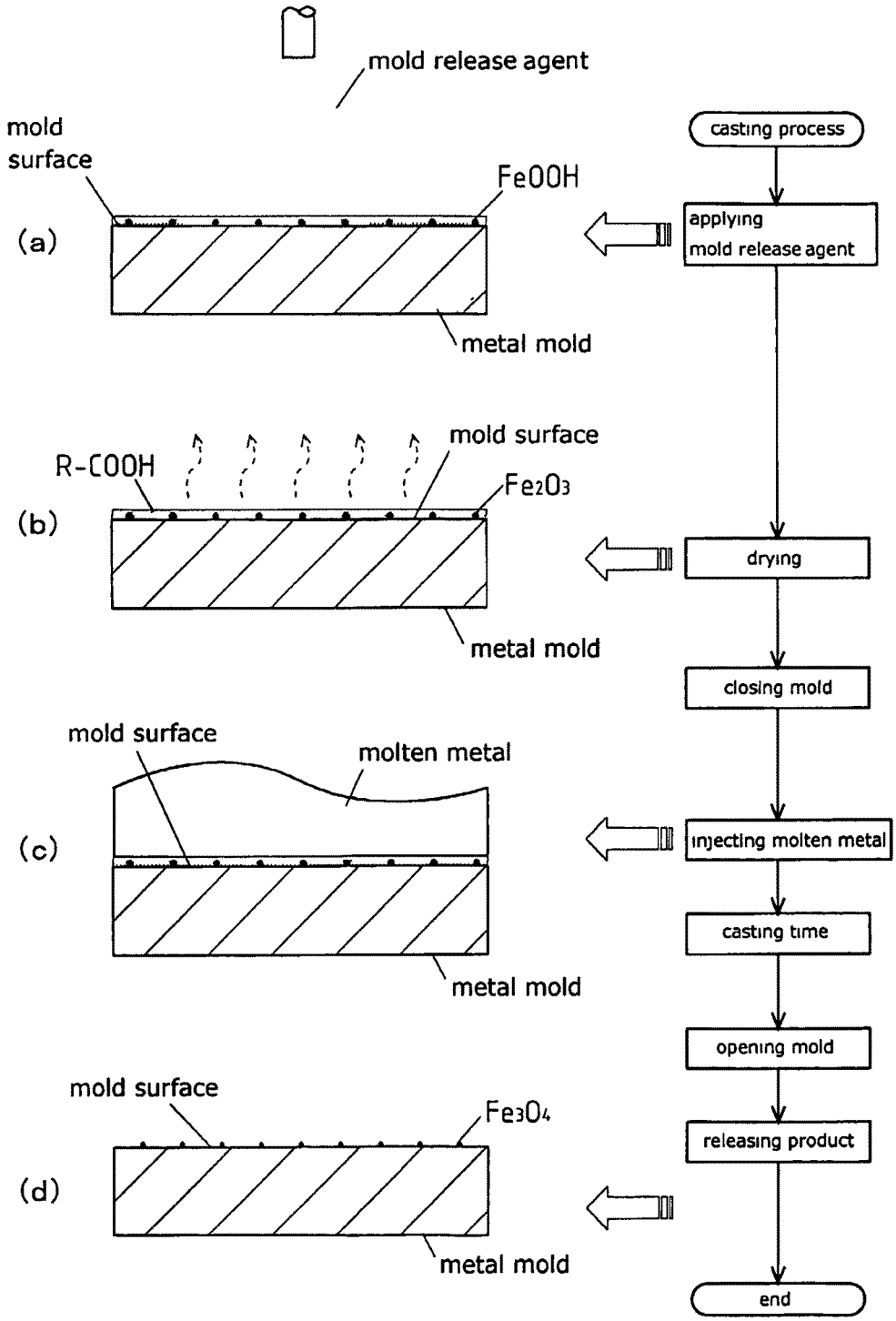
FIG. 1 is a diagram of relation between the casting cycle and the change of the mold surface.
Figure 2:
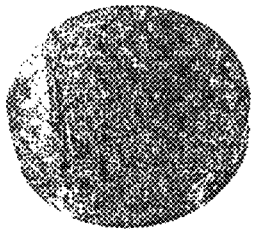
FIG. 2 is a picture of the state of surface films of iron plates difference from each other in the number of simulative casting cycles.
Figure 2:
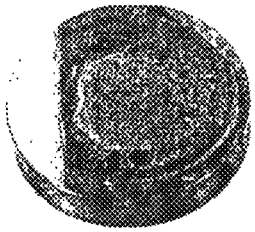
Figure 2:
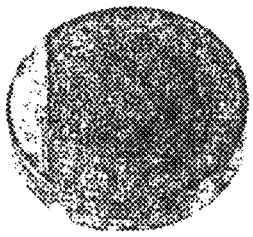
Figure 3:
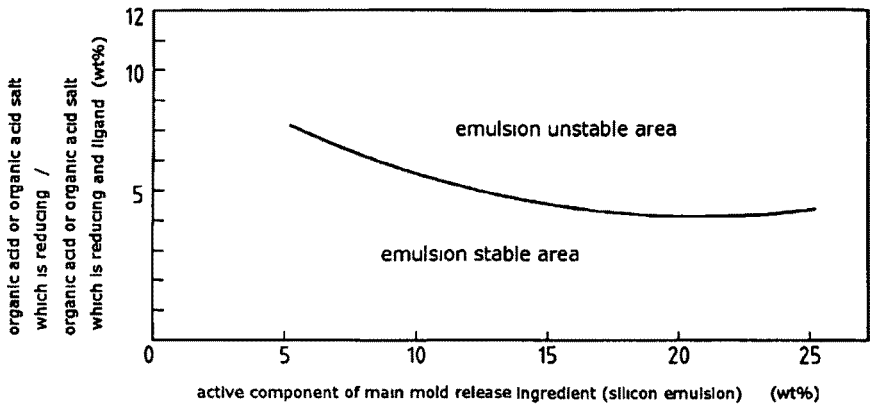
FIG. 3 is a diagram of stability limit in the case that silicon emulsion is adopted as a main mold release ingredient of the mold release agent.

FIG. 1 is a diagram of relation between the casting cycle and the change of the mold surface. FIG. 2 is a picture of the state of surface films of iron plates difference from each other in the number of simulative casting cycles. FIG. 3 is a diagram of stability limit in the case that silicon emulsion is adopted as a main mold release ingredient of the mold release agent.

As shown in FIG. 1, when a mold release agent according to the present invention is applied on a die casting metal mold and then the casting is performed, ferric oxide $Fe_2O_3$ formed on a mold surface by applying the mold release agent on the metal mold is deoxidized to ferrosoferric oxide $Fe_3O_4$. Accordingly, the surface film of $Fe_3O_4$ (black rust) is generated on the mold surface.

The mold release agent according to the present invention contains at least a main mold release ingredient and organic acid or organic acid salt which is reducing, and further contains a ligand so as to obtain higher property of forming the surface film.

In addition, a pH buffer, an antiseptic agent, an anticorrosive agent, a mildew proofing agent, an extreme-pressure lubricant and the like may be added to the mold release agent suitably.

The main mold release ingredient gives mold releasing property to the mold release agent and is a base of the mold release agent.

The main mold release ingredient is made so that a lubricant, such as mineral oil or animal oil, is mixed with silicon oil, wax or fatty acid as a component improving thermal resistance and adhesive property, and then emulsified by a surface active agent. In below explanation, the main components of the mold release agent except water are referred to as active components.

In addition, the main mold release ingredient is not limited to the components according to the present invention. A water-soluble mold release agent, containing base oil commonly used widely, may be adopted as the main mold release ingredient.

As an example of the above-mentioned organic acid which is reducing, citric acid, malonic acid, tartaric acid, formic acid, oxalic acid, gallic acid, ascorbic acid or the combination of two or more thereof can be exhibited. However, another organic acid which is reducing may be adopted.

As an example of the salt of the organic acid salt, metal such as Na, K, Ca, or Mg, ammonium, amine or the combination of two or more thereof can be exhibited. However, another salt constituting organic acid salt which is reducing may be adopted.

The above-mentioned ligand is an electron donor which coordinates with an metal ion. A ligand called a chelating agent is general. As an example of the ligand, matter including N, S, O, P or the like can be exhibited.

As the ligand, bidentate ligand or another multidentate ligand is preferable so as to obtain large effect with small amount.

If the ligand is not mixed with the mold release agent, the working concentration of the organic acid or organic acid salt which is reducing in the mold release agent is made not less than 0.01 wt %. If the ligand is mixed, the working concentration of the total of the organic acid or organic acid salt which is reducing and the ligand in the mold release agent is made not less than 0.01 wt %.

That is because enough effect to deoxidize $Fe_2O_3$ on the mold surface and to promote formation of surface film of $Fe_3O_4$ cannot be obtained if the compounding percentage of the working concentration is less than 0.01 wt %.

In addition, the above-mentioned "working concentration" means the concentration in the working state after diluted with water or the like.

The upper limit of compounding percentage of the organic acid or organic acid salt which is reducing in the case that the ligand is not mixed in the mold release agent or the upper limit of compounding percentage of the total of the organic acid or organic acid salt which is reducing and the ligand in the case that the ligand is mixed is not more than a fixed concentration which is the stability limit of the emulsion as the concentration in undiluted solution of the mold release agent.

That is because, if the compounding percentage is higher than the stability limit of the emulsion, the emulsifying state of the mold release agent is not stable so that the active components are separated from water in the main mold release ingredient.

In addition, the above-mentioned "concentration in undiluted solution" means the concentration in the mold release agent before diluted with water or the like at the time of using (undiluted solution).

The stability limit of the emulsion in the mold release agent before diluted (undiluted solution) is determined according to the ratio of active components of main mold release ingredient contained in the mold release agent.

FIG. 3 is a diagram of the stability limit in the case that silicon emulsion is adopted as the main mold release ingredient of the mold release agent. The diagram indicates that the compounding percentage of the organic acid or organic acid salt which is reducing in the case that the ligand is not mixed or the compounding percentage, of the total of the organic acid or organic acid salt which is reducing and the ligand, which corresponds to the stability limit of the emulsion according to the active components of main mold release ingredient, is changed.

The component weight ratio of the organic acid or organic acid salt which is reducing to the ligand (organic acid or organic acid salt which is reducing/ligand) is in the range from 99/1 to 30/70. Preferably, the component weight ratio of the organic acid or organic acid salt which is reducing to the ligand is in the range from 95/5 to 60/40.

When the above-mentioned component weight ratio is realized, $Fe_2O_3$ on the mold surface is deoxidized to $Fe_3O_4$ at the time of the casting. When the component weight ratio is in the range from 95/5 to 60/40, preferably, $Fe_2O_3$ on the mold surface is fully deoxidized and the surface film of $Fe_3O_4$ is formed stably on the mold surface.

Next, explanation will be given on the casting method using the above-mentioned mold release agent.

As shown in FIG. 1*a*, firstly, the mold release agent is applied on the opened die casting metal mold by spraying.

When the mold release agent is applied, the iron oxyhydroxide FeOOH is formed on the mold surface by the water content in the mold release agent. Then, as shown in FIG. 1*b*, the mold release agent applied on the mold surface is dried so that FeOOH is oxidized further, whereby ferric oxide $Fe_2O_3$ is formed.

Then, the metal mold applied thereon with the mold release agent as the above mentioned is closed and molten metal is injected into a cavity formed by the mold surface. In this embodiment, molten aluminum alloy is adopted as the molten metal.

As shown in FIG. 1*c*, by the heat of the molten metal, $Fe_2O_3$ is deoxidized to $Fe_3O_4$ and the surface film of $Fe_3O_4$ is formed stably on the mold surface. $Fe_3O_4$ is so-called "black rust". In this case, the ligand removes factors inhibiting the deoxidization so as to improve the forming property of the surface film of $Fe_3O_4$ on the mold surface.

In addition, at the time of injecting the molten metal into the metal mold, even if oxide film of magnesium oxide MgO or aluminum oxide $Al_2O_3$ is formed on the molten metal from magnesium or aluminum in the molten metal, the film is deoxidized by the organic acid which is reducing and contained in the mold release agent applied on the mold surface, and the film is vanished, whereby the flowability of the molten metal is maintained so as to improve the flowability in the metal mold.

The surface film of $Fe_3O_4$ formed on the mold surface is finer than the reaction product of $Fe_2O_3$, whereby entrainment of air bubbles into the molten metal is reduced.

According to these reasons, the surface imperfection of the product is inhibited.

Then, after cooling the molten metal for a fixed casting time, the metal mold is opened and the product is released.

In this case, as shown in FIG. 1*d*, the thin and fine surface film of $Fe_3O_4$ is formed on the mold surface so that the molten metal does not adhere to the mold surface stably in contrast with the case that the reaction product of $Fe_2O_3$ exists, whereby the release resistance becomes small so as to reduce the releasing force.

As the above mentioned, the casting cycle comprising the application of the mold release agent, injection, cooling and releasing is repeated in the actual manufacture of die casting productions.

By repeating the casting cycle, the surface film of $Fe_3O_4$ formed on the mold surface grows up to be fine. Namely, by repeating the casting cycle, $Fe_3O_4$ on the mold surface is increased and the surface film of $Fe_3O_4$ becomes finer, whereby the property thereof as a protective film is improved.

The surface film of $Fe_3O_4$ formed on the mold surface is tenacious and is transformable following the thermal expansion and contraction of the mold surface caused by the thermal fatigue. Accordingly, the heat crack is inhibited so as to prevent the life of the metal mold from being shortened.

When the mold surface is polished at the mold polishing work, the surface condition is recovered by the surface film of $Fe_3O_4$ generated by the casting cycle. Accordingly, the metal mold becomes hard to be caused meltdown or seizure.

Accordingly, by adopting the mold release agent according to the present invention, the state of the mold surface is improved further through the casting cycle, whereby the life of the metal mold is extended actively.

Furthermore, the surface film of $Fe_3O_4$ is superior in the resistance against the meltdown by the molten metal. Accordingly, it is not necessary to chip the mold surface at the mold polishing work, whereby the work becomes easy, and the shape of the mold surface is maintained so as to prevent the life of the metal mold from being shortened.

Next, experimentations performed by inventors and the results thereof are described.

[Experimentation 1]

Experimentation 1 is performed for investigating the relation between the deoxidization effect of $Fe_2O_3$ and each of the main mold release ingredient, the organic acid or organic acid salt, and the ligand, which are contained in the mold release agent.

In Experimentation 1, $Fe_2O_3$ is generated on surfaces of simulative iron plates (hereinafter, referred to as iron plates) whose material is SKD-61, and the temperature of the iron plates is raised to 200° C. Then, plural kinds of mold release agents different from each other in the proportion are dropt on the iron plates respectively. After that, the blackening of the surface of each of the iron plates is observed. The blackening of the surface of the iron plate indicates whether $Fe_2O_3$ is deoxidized to $Fe_3O_4$ (black rust) or not.

Below Table 1 shows the result of Experimentation 1. Numerical values shown in Table 1 indicate the proportion of each component in the mold release agents before diluted, and the agents are used for the experimentation without being diluted.

In Table 1, the letter A shows the evaluation that the blackening of the surface of the iron plate is strong. The letter B shows the evaluation that the blackening of the surface of the iron plate is weak. The letter C shows the evaluation that of the surface of the iron plate is not blackened.

In addition, silicon emulsion corresponds to the main mold release ingredient and the active component thereof is 25 wt %. Sodium oleate corresponds to the mold release agent which is not reducing. Trisodium citrate, gallic acid and NaCa-$4H_2O$-tartrate correspond to the organic acid or organic acid salt which is reducing. Diethylenetriamine and H-3Na-$3H_2O$-ethylenediaminetetraacetate (hereinafter, referred to as "EDTA-3Na-$3H_2O$") correspond to the ligand.

TABLE 1

| | examples | | | | | reference examples | | | | |
|---|---|---|---|---|---|---|---|---|---|---|
| | example 1-1 | example 1-2 | example 1-3 | example 1-4 | example 1-5 | reference 1-1 | reference 1-2 | reference 1-3 | reference 1-4 | reference 1-5 |
| water | 18 | 17 | 17 | 17 | 17 | 100 | | | 8 | 18 |
| silicon emulsion | 80 | 80 | 80 | 80 | 80 | | 100 | 80 | 80 | 80 |
| sodium oleate | | | | | | | | 20 | 10 | |
| trisodium citrate | 2 | 3 | 2 | | | | | | | |
| gallic acid | | | | 1 | | | | | | |
| NaCa—$4H_2O$-tartrate | | | | | 2 | | | | | |
| diethylenetriamine | | | | 2 | | | | | | |
| EDTA•3Na•$3H_2O$ | | | 1 | | 1 | | | | 2 | 2 |
| blackening of iron plate * (visual evaluation) | A~B | A~B | A | A | A | C | C | C | B~C | B~C |

* A, strong B, weak C, no blackening

** Numerical values shown in table indicate concentration (wt %) before diluted

The result of Experimentation 1 shows that the surface of the iron plate is blackened in the case using the mold release agent which does not contain the ligand and contains the organic acid or organic acid salt which is reducing. However, the surface of the iron plate is especially blackened in the case using the mold release agent which contains both the organic acid or organic acid salt which is reducing and the ligand.

The mold release agent, which contains the ligand in addition to the organic acid or organic acid salt which is reducing, indicates higher deoxidization effect than that containing no ligand. Accordingly, it is found that the synergistic effect improving the forming property of the surface film of $Fe_3O_4$ on the mold surface by adding the ligand.

In the case using the mold release agent containing only the ligand or the mold release agent containing the organic acid which is not reducing, the surface of the iron plate is hardly to be blackened, whereby it is found that the deoxidization reaction of $Fe_2O_3$ does not occur or occurs slightly.

[Experimentation 2]

Experimentation 2 is performed for investigating the relation between the proportion amount of the organic acid or organic acid salt which is reducing and the ligand and the deoxidization effect of $Fe_2O_3$.

In Experimentation 2, iron plates on which $Fe_2O_3$ is generated are heated to 200° C. Mold release agents different from each other in the concentration are applied on the iron plates by spraying. Then, molten aluminum alloy is injected so as to perform the casting, and the blackening of the surface (a part touching the molten metal) of each of the iron plates is observed.

The proportion of the mold release agent before diluted is 17 wt % of water, 80 wt % of silicon emulsion, 2 wt % of NaCa-$4H_2O$-tartrate, and 1 wt % of EDTA-3Na-$3H_2O$. The mold release agent is diluted suitably and then used.

Below Table 2 shows the result of Experimentation 2. Numerical values shown in Table 2 indicate the mass concentration of each component in the mold release agents after diluted and in the working state. In addition, the blackening is not caused only by spraying the mold release agent. By performing the casting with the molten aluminum alloy, the results in Table 2 are obtained.

TABLE 2

| | example 2-1 | example 2-2 | example 2-3 | example 2-4 |
|---|---|---|---|---|
| NaCa 4$H_2O$-tartrate | 0 008 | 0 0067 | 0.006 | 0 004 |
| EDTA•3Na•$3H_2O$ | 0.004 | 0 0033 | 0 003 | 0.002 |

TABLE 2-continued

| | example 2-1 | example 2-2 | example 2-3 | example 2-4 |
|---|---|---|---|---|
| blackening of iron plate (visual evaluation) | exist | exist | not exist | not exist |

* Numerical values shown in table indicate using concentration (wt %)

The results of Experimentation 2 show that, by the mold release agent containing the organic acid or organic acid salt which is reducing and the ligand whose total concentration is less than 0.01 wt % in the working concentration, the blackening on the surface of the iron plate is hardly caused, that is, the deoxidization effect of $Fe_2O_3$ does not occur or occurs slightly. Accordingly, it is found that the organic acid or organic acid salt which is reducing and the ligand whose total concentration is not less than 0.01 wt % is necessary to be added to the mold release agent.

[Experimentation 3]

Experimentation 3 is performed for investigating the relation between the proportion amount of the organic acid or organic acid salt which is reducing and the deoxidization effect of $Fe_2O_3$ in the case that the ligand is not added.

In Experimentation 3, iron plates on which $Fe_2O_3$ is generated are heated to 200° C. Mold release agents different from each other in the concentration are applied on the iron plates by spraying. Then, molten aluminum alloy is injected so as to perform the casting, and the blackening of the surface (a part touching the molten metal) of each of the iron plates is observed.

The proportion of the mold release agent before diluted is 17 wt % of water and 80 wt % of silicon emulsion, and disodium tartrate or trisodium citrate is added thereto. The mold release agent is diluted suitably and then used.

Below Table 3 shows the result of Experimentation 3. Numerical values shown in Table 3 indicate the mass concentrations of disodium tartrate and trisodium citrate in the mold release agents after diluted and in the working state. In addition, the blackening is not caused only by spraying the mold release agent. By performing the casting with the molten aluminum alloy, the results in Table 3 are obtained.

TABLE 3

| | example 3-1 | example 3-2 | example 3-3 | example 3-4 | example 3-5 | example 3-6 | example 3-7 | example 3-8 |
|---|---|---|---|---|---|---|---|---|
| disodium tartrate | 0.012 | 0 01 | 0 009 | 0.006 | | | | |
| trisodium citrate | | | | | 0.012 | 0.001 | 0.009 | 0.006 |
| blackening of iron plate (visual evaluation) | exist | exist | not exist | not exist | exist | exist | not exist | not exist |

* Numerical values shown in table indicate using concentration (wt %)

The results of Experimentation 3 show that, in the case that the ligand is not added, by the mold release agent containing the organic acid or organic acid salt which is reducing whose concentration is less than 0.01 wt % in the working concentration, the blackening on the surface of the iron plate is hardly caused, that is, the deoxidization effect of $Fe_2O_3$ does not occur or occurs slightly. Accordingly, it is found that, in the case that the ligand is not added, not less than 0.01 wt % of the organic acid or organic acid salt which is reducing is necessary to be added to the mold release agent.

[Experimentation 4]

Experimentation 4 is performed for investigating the relation between the construction ratio of the organic acid or organic acid salt which is reducing and the ligand and the deoxidization effect of $Fe_2O_3$.

In Experimentation 4, iron plates on which $Fe_2O_3$ is generated are heated to 200° C. Mold release agents different from each other in the construction weight ratio of the organic acid or organic acid salt which is reducing and the ligand are applied on the iron plates by spraying. Then, molten aluminum alloy is injected so as to perform the casting, and the blackening of the surface (a part touching the molten metal) of each of the iron plates is observed.

Trisodium citrate as the organic acid or organic acid salt which is reducing and EDTA-3Na-3$H_2O$ as the ligand is added each of the mold release agents so that the total concentration of trisodium citrate and EDTA-3Na-3$H_2O$ is 1 wt %. The construction weight ratios of trisodium citrate and EDTA-3Na-3$H_2O$ in each of the agents are different from each other.

Below Table 4 shows the result of Experimentation 4. Numerical values shown in Table 4 indicate the weight percentage in the mold release agents. In Table 4, the letter A shows the evaluation that the blackening of the surface of the iron plate is strong. The letter B shows the evaluation that the blackening of the surface of the iron plate is weak. The letter C shows the evaluation that of the surface of the iron plate is not blackened.

TABLE 4

| | ex 4-1 | ex 4-2 | ex. 4-3 | ex. 4-4 | ex. 4-5 | ex 4-6 | ex. 4-7 | ex. 4-8 | ex 4-9 | ex. 4-10 | ex. 4-11 | ex. 4-12 |
|---|---|---|---|---|---|---|---|---|---|---|---|---|
| trisodium citrate | 100 | 99 | 98 | 95 | 90 | 80 | 60 | 40 | 30 | 20 | 10 | 0 |
| EDTA•3Na•3$H_2O$ | 0 | 1 | 2 | 5 | 10 | 20 | 40 | 60 | 70 | 80 | 90 | 100 |
| blackening of iron plate * (visual evaluation) | B | A~B | A~B | A | A | A | A | A~B | A~B | B | B | B~C |

* A; strong B, weak C, no blackening

** Numerical values shown in table indicate construction ratio of trisodium citrate and EDTA-3Na—3H2O The results of Experimentation 4 show that $Fe_2O_3$ is deoxidized to $Fe_3O_4$ on the surface of the iron plate (the visual evaluation is B or more) in the case that the construction weight ratio of the organic acid or organic acid salt which is reducing and the ligand is in the range from 100/0 to 10/90. The blackening on the surface of the iron plate appears considerably strongly (the visual evaluation is A or between A and B) in the case that the construction weight ratio of the organic acid or organic acid salt which is reducing and the ligand is in the range from 99/1 to 30/70. Especially, the blackening on the surface of the iron plate appears notably (the visual evaluation is A) in the range from 95/5 to 60/40, whereby it is preferable to prepare the mold release agent to be in this construction weight ratio so as to deoxidize $Fe_2O_3$ sufficiently and to form the surface film of $Fe_3O_4$ on the surface of the iron plate stably.

[Experimentation 5]

Experimentation 5 is performed for investigating the influence which the mold release agent according to the present invention has upon the mold surface.

In Experimentation 5, mold release agents α, β and γ are prepared, and concerning each of them, simulative casting processes of (1) to (4) described below are repeated.

(1) The mold release agent is applied on the surface of the iron plate.

(2) The iron plate is heated to 350° C.

(3) Molten aluminum alloy of 680° C. is flushed on the iron plate.

(4) The aluminum alloy is cooled, and then removed from the iron plate.

The mold release agents α, β and γ are prepared respectively according to below proportion, and then diluted 80 times with water.

The mold release agent α before diluted (17 wt % of water, 80 wt % of silicon emulsion, 2 wt % of trisodium citrate and 1 wt % of EDTA-3Na-3$H_2O$)

The mold release agent β before diluted (100 wt % of silicon emulsion)

The mold release agent γ before diluted (100 wt % of water)

Below Table 5 shows components detected from the surface of substantial center of the range, on which the mold release agent is applied, of the iron plate by a X-ray diffraction apparatus respectively at the time after applying the mold release agent and the time after passing 1 cycle of the simulative casting processes (concerning the mold release agents α and β, the times after passing 10 cycles and 100 cycles in addition thereto).

In Table 5, the double circle shows the evaluation that the peak of the result of compound identification is strong. The single circle shows the evaluation that the peak is clear. The triangle shows the evaluation that the peak is barely checked. The blank shows the evaluation that the peak cannot be checked.

TABLE 5

| components of mold release agent | number of casting cycle | detected matters Fe | $Fe_3O_4$ | $Fe_2O_3$ |
|---|---|---|---|---|
| mold release agent α (water, silicon emulsion, trisodium citrate and EDTA-3Na—3H2O) | 0 times (only applying) | ◎ | ○ | Δ |
| | 1 time | ◎ | ○ | |
| | 10 times | ◎ | ○ | |
| | 100 times | ◎ | ○ | |
| mold release agent β (silicon emulsion) | 0 times (only applying) | ◎ | ○ | Δ |
| | 1 time | ◎ | ○ | Δ |
| | 10 times | ◎ | ○ | Δ |
| | 100 times | ◎ | ○ | Δ |
| mold release agent γ (water) | 0 times (only applying) | ◎ | ○ | Δ |
| | 1 time | ◎ | ○ | Δ |

TABLE 5-continued

| components of mold release agent | number of casting cycle | detected matters Fe | $Fe_3O_4$ | $Fe_2O_3$ |
|---|---|---|---|---|
| none | 0 times (only applying) | ◎ | ○ | Δ |
| | 1 time | ◎ | ○ | Δ |

◎: peak is strong
○: peak is clear
Δ: peak can be checked

The results of Experimentation 5 show that, concerning the mold release agents β and γ, all of Fe, $Fe_3O_4$ and $Fe_2O_3$ exist appear after repeating the simulative casting processes. However, concerning the mold release agent α, though $Fe_2O_3$ exists in the state only the mold release agent is applied, $Fe_2O_3$ does not exist after at least 1 cycle of the simulative casting processes.

Accordingly, it is found that $Fe_2O_3$ vanishes and is modified to $Fe_3O_4$ after the simulative casting processes concerning the mold release agent α, that is, the mold release agent according to the present invention containing the main mold release ingredient, the organic acid or organic acid salt which is reducing, and the ligand.

FIG. 2 shows the change of the surface of the iron plate in the case of repeating the simulative casting processes with the mold release agent α.

This picture shows that, by repeating the simulative casting processes, the blackened part becomes deeper, that is, the surface film of $Fe_3O_4$ formed on the surface of the iron plate becomes more minute. Accordingly, it is found that the surface film of $Fe_3O_4$ formed on the surface of the iron plate becomes more minute by repeating the simulative casting processes with the mold release agent according to the present invention similarly with regard to the actual die casting metal mold.

The invention claimed is:

1. A water-soluble mold release agent for being applied on a mold surface of a metal mold, consisting of:

water;

silicon emulsion;

a reducing agent chosen from citric acid, tartaric acid, a salt thereof, and a combination of two or more thereof; and a ligand being a bidentate ligand or a multidentate ligand, wherein an undiluted total concentration of the reducing agent and the ligand is not more a maximum concentration at which the mold release agent is stably emulsified by a surface active agent, and when diluted and applied on the mold surface, a diluted total concentration of the reducing agent and the ligand is not less than 0.01 wt % based on the total weight of the mold release agent, and wherein a weight ratio of the reducing agent and the ligand ranges from 95:5 to 60:40.

2. A mold release agent as set forth in claim 1, wherein the reducing agent is chosen from citric acid, tartaric acid, and a combination thereof.

3. A casting method wherein:

casting is performed while a mold release agent as set forth in claim 1 is applied on a mold surface of a metal mold, molten metal is injected into the metal mold, and the reducing agent is reacted with a component of the mold surface so as to deoxidize $Fe_2O_3$ on the mold surface to $Fe_3O_4$.

* * * * *